United States Patent [19]

Otterstetter et al.

[11] Patent Number: 4,714,179

[45] Date of Patent: Dec. 22, 1987

[54] POSITIVE DISPLACEMENT PAINT PUSHOUT APPARATUS

[75] Inventors: Charles H. Otterstetter, Southgate; Duane C. Schowiak, Novi; Paul Stueckle, Livonia, all of Mich.

[73] Assignee: Ford Motor Company, Dearborn, Mich.

[21] Appl. No.: 711,882

[22] Filed: Mar. 15, 1985

[51] Int. Cl.[4] ..... B05B 12/14

[52] U.S. Cl. ..... 222/148; 118/302; 222/133; 222/145; 222/334; 222/409; 239/112; 417/401

[58] Field of Search ..... 222/133, 135, 136, 148, 222/334, 395, 409, 145; 417/392, 401; 239/112, 113, 305, 331; 118/302

[56] References Cited

U.S. PATENT DOCUMENTS

| | | | |
|---|---|---|---|
| 1,163,724 | 12/1915 | Weld | 417/401 |
| 3,434,490 | 3/1969 | Lyall | 417/401 X |
| 3,450,092 | 6/1969 | Kock | 118/302 X |
| 3,621,865 | 11/1971 | Baggaley | 417/401 X |
| 3,672,570 | 6/1972 | Scarbrough et al. | 239/112 X |
| 3,716,191 | 2/1973 | Knight | 239/112 |
| 3,870,233 | 3/1975 | Wilhelm et al. | 239/112 X |
| 3,890,922 | 6/1975 | Nordenholt | 222/334 X |
| 3,937,400 | 2/1976 | Krause | 222/395 X |
| 4,116,364 | 9/1978 | Culbertson et al. | 222/334 X |
| 4,229,143 | 10/1980 | Pocher et al. | 417/392 X |
| 4,337,282 | 6/1982 | Springer | 239/112 X |
| 4,375,865 | 3/1983 | Springer | 239/112 X |
| 4,413,647 | 11/1983 | De Lorenzo et al. | 417/392 X |
| 4,509,684 | 4/1985 | Schowiak | 239/305 X |
| 4,547,134 | 10/1985 | Hirvonen | 417/392 X |
| 4,592,305 | 6/1986 | Scharfenberger | 239/112 X |

FOREIGN PATENT DOCUMENTS

| | | | |
|---|---|---|---|
| 0803987 | 2/1981 | U.S.S.R. | 239/112 |
| 0803988 | 2/1981 | U.S.S.R. | 239/112 |

*Primary Examiner*—Robert J. Spar
*Assistant Examiner*—P. McCoy Smith
*Attorney, Agent, or Firm*—Lorraine S. Melotik; Roger L. May

[57] ABSTRACT

The invention relates to an apparatus for dispensing solvent at a predetermined flow rate into a painting apparatus to push paint from the painting apparatus at the required flow rate to maintain the paint spray operation until the end of the paint spray cycle and prior to the start of a color change process.

8 Claims, 1 Drawing Figure

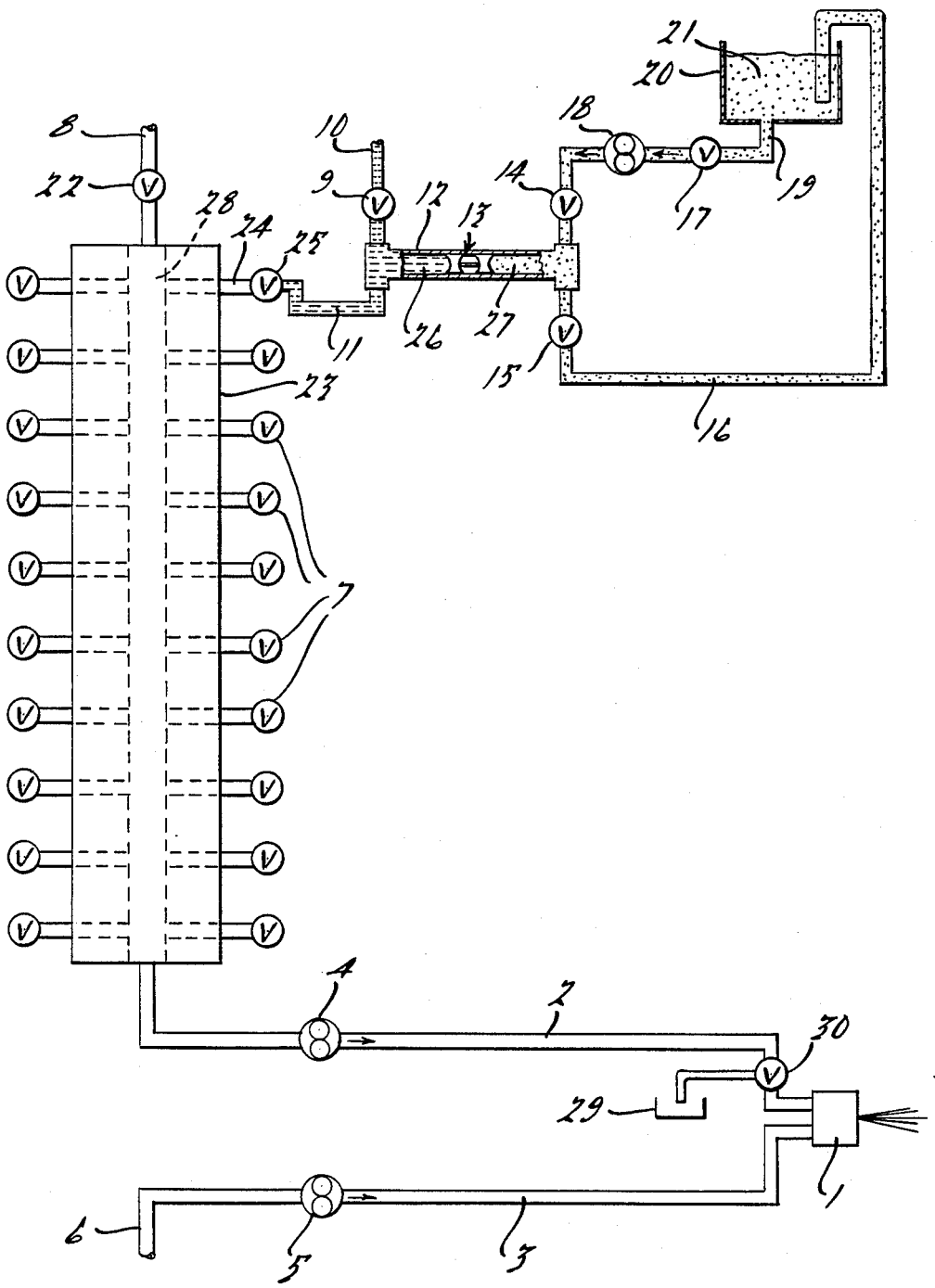
8
22
28
24
25
10
9
12
13
14
18
21
20
19
17
11
26
27
15
16
23
7
4
2
30
29
1
6
5
3

POSITIVE DISPLACEMENT PAINT PUSHOUT APPARATUS

TECHNICAL FIELD

This invention relates to an apparatus for dispensing a measured amount of solvent into a painting apparatus to push out paint from the painting apparatus between color changes of the paint.

BACKGROUND OF THE INVENTION

Paints can be applied to a substrate in a number of ways, e.g., by dipping, brushing, or spraying. For painting large surfaces rapidly, however, the most efficient method for applying paint is by spraying. In automobile production, an automatic paint spraying apparatus is generally employed to paint car bodies on the assembly line. This apparatus includes a color change means which allows the apparatus to spray more than one color of paint. When changing from spraying one paint color to another, the paint flow in the apparatus is stopped and the excess paint in the apparatus is driven out. Afterwards, the spray apparatus is flushed with solvent and air. It is then ready to be used to spray a different color of paint. Many automotive paint spraying assembly line operations change from one color of paint to another every minute, and the cumulative waste of paint that is flushed out of the apparatus over a period of time can be quite costly. It would be advantageous if only a slight excess of paint, over that required to paint the object, would be left in the paint spraying apparatus between color changes. Then, only a small amount of paint would be wasted during the paint cleanout process. This could be accomplished by shutting off the paint prior to the end of the painting cycle and using air or solvent to push the remaining paint through the apparatus to within, for example, a foot of the spray gun. In this way, almost all of the paint in the apparatus could be used in spraying the substrate, and only a small amount of paint would be left in the apparatus between color changes. Consequently, only a small amount of paint, would need to be discharged and disposed of. While both air and solvent can be employed to push the paint out between color changes, their use results in an increased rate of flow of the paint due to a decrease in the friction of the fluid within the paint line. One might attempt to employ metering pumps to control the flow of the paint as it is pushed out by, e.g., solvent. However, currently available gear type, metering pumps are not able to control the speed at which the solvent pushes the paint through the spray apparatus. The difference in viscosity between the paint and the less viscous solvent presents a problem to currently available flushable, metering pumps. These pumps are able to precisely meter materials whose viscosity is similar to that of the paint materials, but are not able to control the metering of the much less viscous solvent to the degree necessary in such painting operations. Since the solvent and paint presents a varied pressure to the pump as solvent travels through the pump, the pump is susceptible to slip. This is particularly a problem in spraying two component paints. In two component paints, the pigmented resin and clear crosslinking agent are fed separately into the spray gun, i.e., they are only combined as they are being sprayed on the substrate. This is in contrast to one component paints which are fed into the spray gun already mixed, i.e., as one component. In two component paint systems, it is critically necessary to maintain a particular ratio of pigmented resin to crosslinking agent in the coating composition. Thus the flow of the two components into the spray gun is carefully metered in a prescribed ratio by means of metering pumps and an electronic control system. If, a solvent were to be used to push the resin out of the apparatus between color changes, the solvent would need to be driven through the apparatus at the speed necessary to maintain the proper ratio of pigmented resin to crosslinking agent in the sprayed composition. If for example, the pigmented resin were to be pushed too fast through the apparatus by solvent, the amount of pigmented resin in the sprayed composition would be more than that necessray for the paint composition. Additionally, the paint could be forced out of the spray gun before the automobile was completely painted, with the result of that solvent would be sprayed on the automobile. Conversely, if the pigmented resin was being pushed by the solvent through the apparatus at too slow a rate, the amount of pigmented resin in the sprayed composition would be less then that necessary for the paint composition, and more pigmented resin would be left in the apparatus between color changes resulting in an excess of paint again being wasted during the flushing. What is necessary is a method for pushing the pigmented resin through the painting apparatus by solvent at a precise rate in order that it may be properly mixed with the crosslinking agent in the spraying apparatus. Additionally, by pushing the resin through the spray apparatus at a precise rate, the resin can be pushed so as to be within a given distance of the spray gun at the time that the substrate has been fully painted and thus minimize the amount of paint which will be flushed out. It is not, however, possible to control with any accuracy the speed at which the pigmented resin would be pushed through the system by solvent if one uses currently available flushable metering pumps to meter the solvent.

BRIEF DESCRIPTION OF THE INVENTION

This invention is directed to an apparatus for dispensing a measured amount of solvent into a painting apparatus to push out paint from the painting apparatus between color changes. The apparatus of this invention comprises:

(A) a chamber separated into variable volume first and second compartments by separating means which is free to move within the chamber so as to vary the volume of the first and second compartments;

(B) means for dispensing solvent into the first compartment;

(C) means for dispensing solvent from the first compartment into the painting apparatus;

(D) metering means for dispensing viscous fluid into the second compartment; and (E) means for dispensing the viscous fluid from the second compartment, wherein during a solvent fill cycle solvent flows into the first compartment while at the same time an equal amount of viscous fluid flows out of the second compartment, and wherein during a solvent dispensing cycle viscous liquid flows into the second compartment while at the same time an equal amount of solvent flows into the painting apparatus.

The invention in this application is also directed to the apparatus described above in combination with a paint spray apparatus comprising a color change apparatus.

This invention minimizes the problems described above relating to paint pushout between color changes by providing an apparatus which may be employed to push paint out of the painting apparatus at a very critically controlled flow rate and in a metered amount.

One advantage of the apparatus of this invention is that it can effectively control the rate of flow of the paint being pushed out of the painting apparatus between color changes so as to maintain the proper proportion of pigmented resin and crosslinking agent in the composition applied to the substrate.

Another advantage of the apparatus of this invention is that it can effectively control the amount of paint pushed out of the paint spray apparatus in a given time, and thus in essence, it can control the amount of paint left in the paint spray apparatus at the completion of the painting operation.

BRIEF DESCRIPTION OF THE DRAWINGS

The FIGURE is a cross-sectional view of one embodiment of an apparatus according to this invention for dispensing a measured amount of solvent into the color change means of a spray painting apparatus for applying two component paints.

DETAILED DESCRIPTION OF THE INVENTION

Other features and advantages of this invention will be apparent from the succeeding, detailed description thereof. The invention is best understood by referring to the drawing.

The drawing depicts a spray apparatus, including the paint pushout apparatus of this invention, for applying a two-component paint. The color resin is fed through color valve 7, through metering pump 4, through line 2 into spray gun 1, while at the same time the clear crosslinking agent is fed from crosslinking agent supply line 6, metered by positive displacement pump 5, and fed through line 3 into spray gun 1. At the beginning of the paint pushout cycle of the apparatus (i.e., the cycle whereby solvent is dispensed into the paint apparatus to pushout the paint), color valve 7 of the color resin being sprayed is closed. At this time, control valves 9 and 15 are closed, the solvent port control valve 25 is opened, viscous material supply control valve 14 is opened, and the viscous material positive displacement pump 18 is started. With control valves 9 and 15 closed, the viscous material 21 flows from the viscous material supply tank 20 through supply line 19, check valve 17, positive displacement pump 18, and control valve 14 into the second compartment 27 of chamber 12. This forces separating means 13 to the left and displaces a controlled flow of solvent out of the prefilled first compartment 26 of chamber 12. The controlled flow of the solvent through supply line 11, control valve 25, through solvent port 24 into the common color change manifold 28 of color change apparatus 23, through master color displacement pump 4, color supply line 2 and three-way dump valve 30, which is open to the spray gun and line 2, forces a controlled flow of the color component ahead of it and out through the spray gun 1. At the end of the spray cycle, the spray gun is shut off, the viscous material positive displacement pump 18 is stopped and viscous material supply valve 14 is closed. Subsequently, solvent control valve 9 is opened, viscous material return valve 15 is opened, and dump valve 30 is opened to line 2 and solvent recovery tank 29. Solvent from high pressure supply line 10 flows through valve 9, line 11, valve 25, solvent port 24, through color changer 28, through line 2, out through dump valve 30, into solvent recovery tank 29. At this time, flush solvent under the high pressure of the solvent supply line 10 forces the separating means 13 in chamber 12 to the right, filling the first compartment 26 of the chamber with solvent and pushing the viscous material in the second compartment 27 of the chamber past control valve 15 through line 16. In the preferred embodiment of this invention, the apparatus would include a means for returning the viscous material from line 16 back to supply tank 20. However such viscous material can instead be disposed of, if such is desired.

At the end of the solvent fill cycle, valve 25 is closed and subsequently valve 9 is closed. Three way valve 30 is opened to the spray gun and line 2, then valve 22 is opened, allowing high pressure air from air supply line 8 to blow out the color change head, color line and clear the gun of solvent. Valve 30 is then opened to solvent recovery tank 29, valve 22 is closed and a new color line is opened to prefill the color change head and color supply line 2, color pump 4, while dumping a small amount of new color to the solvent recovery tank 29. Thereafter, valve 30 is opened to spray gun 1 and a new paint cycle is started.

Pumps 4 and 18 are positive displacement gear pumps. While pump 4 must be flushable pump, pump 18 need not be flushable. The flushable pumps, as compared to non-flushable pumps, include a by-pass valve around the gears within the pump. During color change operation, this valve is opened so that high velocity air or solvent is permitted to by-pass the gears and pass from the pump inlet to outlet port, as well as through the pump (gears). This allows a rapid scrubbing action to take place in (through) pump 5, color supply line 2, dump valve 30 to recovery tank 29 on spray gun 1. Exemplary of such a flushable pump is that taught in U.S. patent application Ser. No. 601,110, filed Apr. 18, 1984. During the solvent pushout cycle, pump 4 and pump 18 are set to operate at the same rate of material delivery. The pump can be driven at the proper RPM by step motors, which may be manually controlled or be automatically controlled by a microprocessor or programable controller.

The viscous material 21 may be a material, such as dioctyl phthlate, which is compatible with the paint and solvent and which has a viscosity similar to that of the paint being pushed out. This assures that in the event that any viscous fluid leaks past the separating means in the chamber, it will not adversely affect the system or painting operation. Generally a viscosity of about 14 to 26 seconds measured with a #4 Ford cup at 80° F. would be suitable for the viscous material employed in the paint pushout process of this invention.

The amount of solvent ahead of the separation means in the chamber must be sufficient to fill the spray apparatus to within a given distance of about, e.g., one foot of spray head 1, during the solvent dispensing cycle. For example, in a standard paint assembly operation, the length of hose 2 to spray gun 1 is about 10 feet long, and the amount of solvent required to be dispensed into the spray apparatus during the solvent dispensing cycle to push the paint to within about a foot of spray gun 1 is between about 150–200 cc.

Separating means 13 between the first and second compartments of the chamber may be a solid movable separating means. Preferably, chamber 12 is a cylindrical chamber and as is depicted in the drawing, the separating means 13 therein comprises two circular, disc shaped pistons arranged perpendicular to the longitudinal axis of the chamber and a stabilizing means for the pistons, e.g., a bar, whereby the pistons are affixed apart from each other. The separating means should form a liquid tight seal with the walls of the chamber so as to prevent the viscous material and solvent from leaking past the separating means.

While the apparatus of this invention has been taught as having particular usefulness with a two component paint spraying apparatus, the apparatus of this invention is not limited to such a system. It may, for example, be used to push paint out of a one component paint spraying apparatus between color changes. While particular embodiments of this invention, e.g., relative the viscosity of the material, amount of solvent to be dispersed into the paint spraying apparatus, separating means, etc., have been discussed above, they are not meant to be limiting to the apparatus of this invention. Selection of the optimal characteristic of such variables of the invention would be well within the skill of those in the art.

In view of the disclosure, many modifications of this invention will be apparent to those skilled in the art. It is intended that all such modifications which falls within the true scope of this invention be included within the terms of the appended claims.

We claim:

1. An apparatus for dispensing a measured amount of solvent at a precisely controlled flow rate into a painting apparatus, which comprises:

(A) a chamber separated into variable volume first and second compartments by separating means which is free to move within said chamber so as to vary the volume of said first and second compartments;

(B) means for dispensing solvent into said first compartment;

(C) means for dispensing said solvent from said first compartment into said painting apparatus;

(D) metering means comprising a motor driven, positive displacement gear pump for dispensing viscous fluid at said precisely controlled flow rate into said second compartment; and (E) means for dispensing said viscous fluid from said second compartment, wherein during a solvent fill cycle, said solvent is dispensed into said first compartment while at the same time an equal amount of said viscous fluid is dispensed from said second compartment, and wherein during a solvent dispensing cycle, said viscous fluid is dispensed at said precisely controlled flow rate into said second compartment while at the same time an equal amount of said solvent is dispensed at said precisely controlled flow rate from said first compartment into said painting apparatus.

2. Apparatus according to claim 1, wherein said metering means allows for dispensing a desired volume of said viscous fluid at a desired rate into said second compartment.

3. Apparatus according to claim 1, wherein said chamber is a cylindrical chamber.

4. An apparatus according to claim 3, wherein said separating means comprises two circular pistons arranged perpendicular to the longitudinal axis of said cylindrical chamber and a stabilizing means by which said pistons are affixed apart from each other.

5. An apparatus according to claim 1, which further comprises a reservoir for said viscous fluid which is dispensed into said second compartment and subsequently dispensed from said second compartment.

6. A painting system which comprises:

I. a paint apparatus capable of spraying paint, and

II. an apparatus for dispensing a metered amount of solvent at a precisely controlled flow rate into said painting apparatus, which comprises:

(A) a chamber being separated into variable volume first and second compartments by a separating means which is free to move within said chamber so as to vary the volume of said first and second compartments, (B) means for dispensing solvent into said first compartment, (C) means for dispensing said solvent from said first compartment into said painting apparatus, (D) metering means comprising a motor driven, positive displacement gear pump for dispensing viscous fluid at said precisely controlled flow rate into said second compartment, and (E) means for dispensing said viscous fluid from said second compartment, wherein during a solvent fill cycle, said solvent is dispensed into said first compartment while at the same time an equal amount of said viscous fluid is dispensed from said second compartment, and wherein during a solvent dispensing cycle, said viscous fluid is dispensed at said precisely controlled flow rate into said second compartment while at the same time an equal amount of said solvent is dispensed at said precisely controlled flow rate from said first compartment into said painting apparatus.

7. A painting system according to claim 6, wherein said painting apparatus comprises a color change apparatus for effecting change of the sprayable fluid to be applied using a spray gun.

8. A painting system according to claim 7, wherein said color change apparatus is capable of effecting color change of the color component of a multiple component sprayable fluid.

* * * * *